US010607434B2

(12) United States Patent
Carmine

(10) Patent No.: US 10,607,434 B2
(45) Date of Patent: Mar. 31, 2020

(54) SYSTEM TO PROCESS A VALUABLE DOCUMENT

(71) Applicant: Crane Payment Innovations, Inc., Malvern, PA (US)

(72) Inventor: Christopher Stephen Carmine, Thornton, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 565 days.

(21) Appl. No.: 14/770,408

(22) PCT Filed: Feb. 20, 2014

(86) PCT No.: PCT/US2014/017345
§ 371 (c)(1),
(2) Date: Dec. 2, 2015

(87) PCT Pub. No.: WO2014/130644
PCT Pub. Date: Aug. 28, 2014

(65) Prior Publication Data

US 2016/0086410 A1 Mar. 24, 2016

Related U.S. Application Data

(60) Provisional application No. 61/768,739, filed on Feb. 25, 2013.

(51) Int. Cl.
*G07D 7/12* (2016.01)
*G07D 7/121* (2016.01)

(52) U.S. Cl.
CPC ..... *G07D 7/121* (2013.01); *G07D 7/12* (2013.01)

(58) Field of Classification Search
CPC ..... G07D 7/06; G07D 7/121; G07D 7/162
(Continued)

(56) References Cited

U.S. PATENT DOCUMENTS 4,821,332 A 4/1989 Durham
5,758,759 A 6/1998 Negishi
(Continued)

FOREIGN PATENT DOCUMENTS

AT 390684 B 6/1990
EP 2015258 A2 1/2009
(Continued)

OTHER PUBLICATIONS

International Search Report dated Jun. 10, 2014 in connection with International Patent Application No. PCT/US2014/017345; 3 pages.
Written Opinion of International Searching Authority dated Jun. 10, 2014 in connection with International Patent Application No. PCT/US2014/017345; 5 pages.
Notification of the Second Office Action for Chinese Patent Application No. 201480018111.3 dated Apr. 16, 2018; 7 pages.
Communication from a foreign patent office in a counterpart foreign application, "Notification of Reasons for Refusal," Japanese Patent Application No. JP 2015-558944, dated Nov. 29, 2017, 14 pages.
(Continued)

*Primary Examiner* — Kevin K Pyo

(57) ABSTRACT

A sensing system to process at least one valuable document is described herein. The system includes a light source to generate a light beam. The system also includes at least one light pipe having one or more diverting surfaces to direct the light beam at a predetermined angle of incidence onto the valuable document. At least one reflective surface, to receive a first portion of the light beam transmitted through the valuable document and to reflect off the first portion of the light beam towards the valuable document, is included. A light detector is configured to receive at least a second portion of the light beam re-transmitted through the valuable document.

17 Claims, 7 Drawing Sheets

(58) Field of Classification Search
USPC ..... 250/556, 559.4; 356/71; 235/454
See application file for complete search history.

(56) References Cited

U.S. PATENT DOCUMENTS

| | | | | |
|---|---|---|---|---|
| 5,896,192 | A | 4/1999 | Nagase | |
| 7,633,605 | B1 * | 12/2009 | Kallin | G07D 11/0036 235/454 |
| 8,139,208 | B2 | 3/2012 | Kayani | |
| 8,432,589 | B2 | 4/2013 | Tompkin et al. | |
| 2005/0248767 | A1 | 11/2005 | Pilloud et al. | |
| 2010/0259749 | A1 * | 10/2010 | Zoladz | G02B 6/0038 356/71 |
| 2017/0092033 | A1 * | 3/2017 | Stewart | G07D 7/121 |

FOREIGN PATENT DOCUMENTS

| | | | |
|---|---|---|---|
| JP | H06-208613 | A | 7/1994 |
| JP | H06-333125 | A | 12/1994 |
| JP | H1063915 | A | 3/1998 |
| JP | 2003-254910 | A | 9/2003 |
| JP | 2008-239412 | A | 10/2008 |
| JP | 2008-293412 | A | 12/2008 |
| JP | 2010-529913 | A | 9/2010 |
| WO | 2012083428 | A1 | 6/2012 |

OTHER PUBLICATIONS

Communication from a foreign patent office in a counterpart foreign application, Japan Patent Office, "Final Decision for Rejection," Application No. JP 2015-558944, dated Aug. 28, 2018, 6 pages.
CIPO, Examination report in connection with Canadian Application No. CA 2,902,500, dated Jun. 25, 2019, 3 pages.
IP Australia, "Examination report No. 1 for standard patent application," Application No. AU2018203420, dated Apr. 3, 2019, 4 pages.
State Intellectual Property Office of the People's Republic of China Rejection Decision regarding Application No. 201480018111.3, dated Nov. 26, 2018, 14 pages.
European Patent Office, "Supplementary European Search Report," Application No. EP 14754659.2, dated Oct. 7, 2016, 4 pages.
European Patent Office, "Communication pursuant to Article 94(3) EPC," Application No. EP 14754659.2, dated Nov. 4, 2016, 5 pages.
Japan Patent Office, "Notice of Reasons for Refusal," Application No. JP 2015-558944, dated Oct. 15, 2019, 13 pages.
State Intellectual Property Office of the People's Republic of China, "Notification of Reexamination," Application No. CN 201480018111.3, dated Nov. 11, 2019, 25 pages.

* cited by examiner

SYSTEM TO PROCESS A VALUABLE DOCUMENT

CROSS-REFERENCE TO RELATED APPLICATION(S)

The present application claims priority under 35 U.S.C. § 365 to International Patent Application No. PCT/US2014/017345 filed Feb. 20, 2014, entitled "SYSTEM TO PROCESS A VALUABLE DOCUMENT; International Patent Application No. PCT/US2014/017345 claims priority under 35 U.S.C. § 365 and/or 35 U.S.C. § 119(a) to U.S. Patent Application No. 61/768,739 filed Feb. 25, 2013, which is incorporated herein by reference into the present disclosure as if fully set forth herein.

TECHNICAL FIELD

The present subject matter relates, in general, to a valuable document and, in particular, to a method and a system to process the valuable document, such as a banknote, valuable paper, security document, coupon, etc., within an electronic transaction system, such as a currency validator, automatic teller machine, gaming machine, and vending machine.

BACKGROUND

Traditionally, valuable documents such as banknotes are printed on cotton-fiber paper substrates, which are inherently opaque. In order to combat counterfeiting and provide better durability, banknotes are now being developed with substrates that allow incorporation of complex security features. Banknote security has seen a paradigm shift with the advent of polymer substrates, which are optically transparent. When banknotes are printed on polymer substrates, an area of substrate is left free or transparent of any background and graphics so that an opaque material cannot be used for counterfeiting banknotes. The transparent area is hereinafter referred to as a "transparent window". The transparent window may sometimes extend from one edge of the note to the other.

Typically, electronic transaction systems, such as vending machines, include currency handling units having one or more sensors to determine both authenticity and progress of the banknote along a transport path. The traditional sensors include a source of light that is generally placed along the transport path such that the angle of incidence of light is normal to the surface of the banknote. The ratio of the reflected light from the banknote to transmitted light through the banknote helps determine whether a banknote is present or not. However, banknotes with transparent windows may not be detected by the traditional sensors as light transmits almost completely through the banknote. As a result, a light detector detecting transmitted light energy sees it as an absence of bank note or a trailing edge/end of a banknote. This problem is particularly pronounced in cases where the transparent window extends across the width of the banknote. Inaccurate detection of transparent windows leads to miscalculation of length of the banknote, which then causes a valid banknote to be rejected as being too short. The miscalculation of length also causes the electronic transaction system to see two or more banknotes instead of one and the banknotes may be double counted causing problems in, for example, recycling type applications.

SUMMARY

This summary is provided to introduce concepts related to a system and method to process valuable documents, such as banknotes and checks. The concepts are further described below in the detailed description, drawings and claims. This summary is not intended to identify essential features of the claimed subject matter nor is it intended for use in determining or limiting the scope of the claimed subject matter.

Computer program products are also described that comprise non-transitory computer readable media storing instructions, which when executed by at least one data processors of one or more computing systems, causes at least one data processor to perform operations herein. Similarly, computer systems are also described that may include one or more data processors and a memory coupled to the one or more data processors. The memory may temporarily or permanently store instructions that cause at least one processor to perform one or more of the operations described herein. In addition, methods can be implemented by one or more data processors either within a single computing system or distributed among two or more computing systems.

A sensing system to process at least one valuable document is described herein. In one implementation, the system includes a light source to generate a light beam. The system also includes at least one light pipe having one or more diverting surfaces to direct the light beam at a predetermined angle of incidence onto the valuable document. At least one reflective surface, to receive a first portion of the light beam transmitted through the valuable document and to reflect the first portion of the light beam towards the valuable document, is also included. A light detector is configured to receive at least a second portion of the light beam transmitted through the valuable document. Intensity of the second portion of the light beam is based at least on the angle of incidence. The angle of incidence, number of passes, refractive effects, etc., influence extinction ratios. Further, the reflective surface is angled such that the first portion of the light beam reflecting from the reflective surface reflects off substantially in a direction towards the valuable document.

A light detector is configured to receive at least the portion of the light beam transmitted through the valuable document. At least one of the diverting surfaces is angled between 0 and about 90 degrees.

The sensing system can further include at least one controller configured to vary the angle of incidence by varying an angle of the diverting surface. The sensing system can be implemented in one of a vending machine, an automatic teller machine, a gaming machine, a currency validator, and a bill validator, or any other device configured to accept valuable documents in exchange for product or service. Examples of the valuable document include, but are not limited to, a coupon, a check, a security document, a banknote, and a voucher, where the valuable document may have one or more transparent windows. The valuable document can be a polymer banknote.

The light detector is coupled to a controller, where the controller is configured to store data of the second portion of the light beam, and compare the data of the second portion of the light beam with a predetermined value. The controller determines presence of the valuable document based at least on the comparison.

In another implementation, a method to process a valuable document is described herein. The method includes emitting a light beam from a light source onto a valuable document, optimizing reflected energy off the valuable document by varying an angle of incidence of the light beam, orienting a reflective surface such that a first portion of the light beam through the valuable document is reflected towards the valuable document, and obtaining a second portion of the light beam re-transmitted through the valuable document. The second portion of the light beam is a part of the first portion of the light beam. The method can further include storing the intensity data of the transmitted light beam, and comparing the aforementioned intensity data with a predetermined value. A differentiation between a presence of the valuable document and an absence of the valuable document can also be made based at least on the comparison. Additionally or optionally, differentiation between the valuable document and other types of documents can also be made based at least on the comparison. The method can be implemented in one of a vending machine, an automatic teller machine, a gaming machine, a currency validator, a pay phone, a computer, and a hand-held device, or any other device configured to accept valuable documents in exchange for goods or services.

In one implementation, the transmitted light beam is made to undergo one or more passes (i.e. transmissions) through the valuable document before being read by a light detector.

In another implementation, a method to detect transparent windows in valuable documents includes varying an angle of incidence of a light beam onto a valuable document such that reflected energy off the valuable banknote is optimized. The method further includes allowing the light beam to undergo one or more passes through the valuable document, where reflective and geometric effects due to refraction multiply with each pass. The presence of the valuable document is determined based on transmitted energy received after the one or more passes through the light beam. Further, a system implementing the method above is also described.

BRIEF DESCRIPTION OF THE DRAWINGS

The detailed description is provided with reference to the accompanying figures. In the figures, the left-most digit(s) of a reference number identifies the figure in which the reference number first appears. The same numbers are used throughout the drawings to reference like features and components. For simplicity and clarity of illustration, elements in the figures are not necessarily to scale.

FIG. 5(*b*) illustrates that at about 45 degree angle of incidence, the amount of light reflected off the valuable document increases as compared to normal incidence, according to the present subject matter.

FIG. 5(*c*) illustrates that at about 80 degree angle of incidence; a minimal amount of light transmits through the valuable document and misses a light detector due to geometric shift, according to the present subject matter.

DETAILED DESCRIPTION

Figure 1:
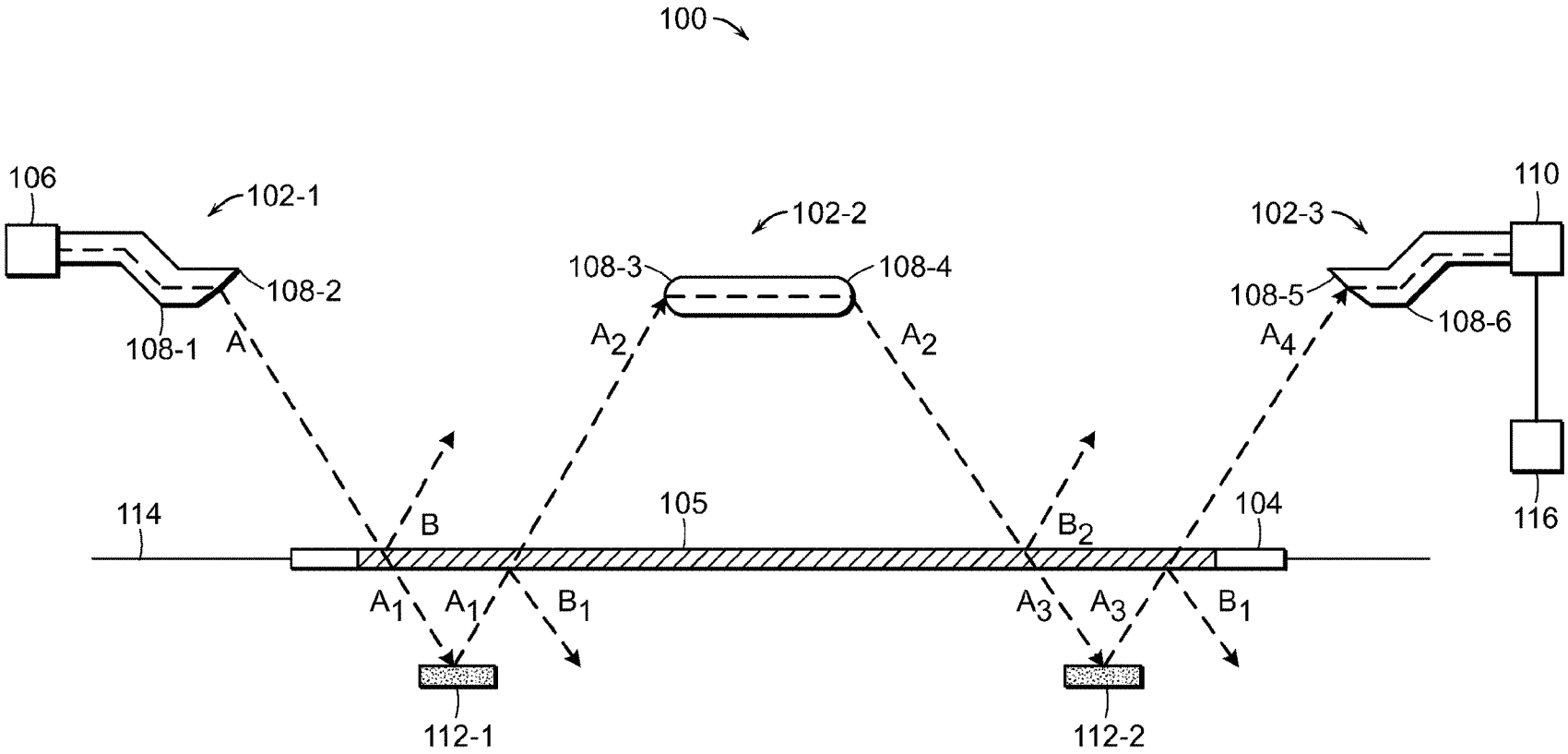
FIG. 1 illustrates an exemplary sensing system for processing valuable documents, in accordance with the present subject matter.

A sensing system configured to process one or more valuable documents is disclosed herein. The sensing system can be implemented within any electronic transaction system, such as a vending machine, a gaming machine, an automatic teller machine, a pay phone, etc., and in general any equipment used in retail, gaming, or banking industry.

Examples of valuable documents include, but are not limited to, banknotes, security papers, checks, and coupons printed on a synthetic polymer substrate, which is optically transparent. In an example, when a banknote is printed on the polymer substrate, a part of the substrate is printed with an opaque background. As an additional security feature, part of the banknote is left free of any background and graphics so that an opaque material cannot be used for producing counterfeit banknotes. The transparent area is hereinafter referred to as "transparent window". The transparent window may extend across a part or entire width or length of the banknote. It is within the scope of the present disclosure that traditional type valuable documents (e.g., paper substrate documents) may be constructed to include a transparent window as described herein.

A valuable document, such as a banknote with transparent windows, is generally transported within an electronic transaction system along a transport path. For example, the banknote may be transported from a banknote receiver to recycler or bundler along the transport path. Typically, the banknote is transported past a plurality of sensors, including light sources for illuminating the banknote and light detectors for detection of light reflected off or transmitted through the banknote. As a result, one or more sensor signals are generated corresponding to measurements taken from different areas of the banknote. The sensor signals are then processed to validate and/or track the progress of the banknote. However, conventional sensor systems typically project light at a normal angle of incidence to the surface of the banknote, and in the case of banknotes with transparent windows, a substantial amount of light passes through the banknote. The sensor perceives this as an absence of a banknote. In other words, the ratio between the light reflected off a polymer banknote surface to the light transmitted through the polymer banknote surface is not as high as compared to the similar ratio computed for conventional paper banknotes. This ratio is hereinafter referred to as the extinction ratio. Such low extinction ratios lead to incorrect determination of progress of the banknotes or any such valuable documents with transparent windows.

To this end, the embodiments provided herein describe a system and method to correctly differentiate valuable documents, such as banknotes with transparent windows, from an absence of the valuable document. The embodiments are hereinafter described with reference to banknotes with transparent windows, however other implementations are possible as would be understood by a person skilled in the art.

In one embodiment, a sensing system having one or more light sources and one or more light detectors are placed along the transport path to track the progress of the banknote. The light source is configured to emit light at predefined intervals. The at least one light source may be used to emit light at a number of wavelengths in a short period of time to ensure high security against fraud. At least one light detector (e.g. phototransistor or photodiode) detects light reflected off or transmitted through the banknote. The sensing system also includes one or more reflecting surfaces located on an opposite side of the transport path relative to light emitted from the light source.

In said embodiment, light from the light source passes through one or more light pipes onto surface of the banknote. Further, the light pipes can include one or more diverting surfaces oriented to optimize the reflection coefficient, and thereby increase the reflected energy off the banknote. Light impinging onto the surface of the banknote is then in part reflected off and in part transmitted through the valuable document. This is defined as one pass through the document. After passing through the banknote, such as the transparent windows of the banknote, the light reflects off the reflective surfaces to pass back through the banknote again. In this manner, the light may be made to pass through the banknote a desired number of times. At each pass, the light undergoes degradation due to reflection losses and transmission losses until the energy of the transmitted light is read by the light detector. Additionally, due to the geometric shift at each interface, say that of the banknote or reflective surface, the light beam may even miss the light detector giving an impression that a banknote is present. Thus, in this fashion, the extinction ratios of banknotes with transparent windows are considerably increased.

The conventional sensors would treat a banknote with transparent windows as an absence of note but in the present subject matter, the angle of incidence of light is controlled to optimize the reflection coefficient. At normal incidence, or in other words at zero degree angle of incidence, the reflection coefficient for most polymer or plastic materials is about 4%. As the angle of incidence increases, the reflection coefficient increases. Thus, by varying the angle of incidence of the incident light, the sensing system can detect the presence of a transparent window, such as by measuring the difference in incident energy and the reflected/transmitted energy or even extinction ratios. The pattern of the reflected or transmitted energy can also be compared to an expected pattern for an acceptable banknote to determine the presence of the banknote with transparent windows, and in some cases, even the validity of the banknote with transparent windows. Further, the angle of incidence is controlled such that no total internal reflection occurs within the valuable document. The transmitted energy through the banknote decreases as the angle of incidence increases. The transmitted energy also undergoes geometric shift due to refraction. The geometric shift in transmitted energy, too, increases as the angle of incidence increases.

In another implementation, the sensing system includes a controller configured to orient at least one of the light source and diverting surfaces within the light pipes, based at least on a desired value of extinction ratios. By varying the orientation of the light source and light pipes, the angle of incidence of light from the light source onto the surface of the banknote varies between 0 degree to about 90 degrees. This, in turn, helps to optimize the reflected energy off the banknote. In an example, the selection of the angle of incidence is based at least on software and hardware limitations and the reflection coefficient of the banknote.

It will be appreciated that the embodiments described herein can be used in a standalone unit, or for incorporation into a conventional electronic transaction system, such as an ATM, which requires a sensor for valuable documents. Additional sensing units may be implemented to determine authenticity of the banknote as will be understood by a person skilled in the art.

While aspects of the described processing of valuable documents can be implemented in any number of different systems, environments, and/or configurations, the embodiments are described in the context of the following exemplary system(s). The descriptions and details of well-known components are omitted for simplicity of the description. It will be appreciated by those skilled in the art that the words during, while, and when as used herein are not exact terms that mean an action takes place instantly upon an initiating action but that there may be some small but reasonable delay, such as a propagation delay, between the initial action, and the reaction that is initiated by the initial action.

FIG. 1 illustrates a sensing system 100 having a plurality of light pipes 102, according to an implementation of the present subject matter. The sensing system 100 can be implemented within an automatic transaction machine (ATM), a gaming machine, a kiosk, a bill acceptor, or a vending machine. In one implementation, sensing system 100 can be any hardware or software or any combination thereof, which may be configured to process one or more valuable documents 104, such as coupons, checks, security documents, banknotes, vouchers, and the like having one or more transparent windows 105. The processing of valuable document 104 includes, but is not limited to, determination of whether the valuable document 104 is present and in some implementations, a further determination of whether the valuable document 104 includes at least one transparent window 105 on an otherwise opaque material. The transparent window 105 may extend from one end of the banknote 104 to other. For clarity and better understanding, the subject matter is described with reference to banknotes 104 with transparent windows 105, such as polymer banknotes from Canada, Mexico, Australia, etc.; however, the description can be extended to different kinds of valuable documents 104 as will be understood by a person skilled in the art. The banknotes 104 with transparent windows 105 are hereinafter interchangeably referred to as banknotes 104, transparent banknotes 104 or polymer banknotes 104.

In one embodiment, the sensing system 100 includes a plurality of light pipes 102-1, 102-2, . . . , 102-N, collectively referred to as light pipe(s) 102, and at least one light source 106, such as a light emitting diode (LED). Each of the light pipes 102 is a waveguide having a first end and a second end. In one embodiment, the first and/or second ends include one or more diverting surfaces 108-1, 108-2, etc., (collectively referred to as diverting surfaces 108) to orient the incoming light at a desired angle of incidence. In an example, the angle of incidence is about 45 degrees. For the sake of clarity, the first end of the waveguide is defined as the end which receives the light (alternatively referred to as light beam) whereas the second end is the end from where the light exits or is transmitted. For example, the first end of the first light pipe 102-1 receives light from the light source 106 and the second end of first light pipe 102-1 includes diverting surfaces 108-1 and 108-2 to orient the exiting light at an angle of about 45 degrees. Further, the first end of the second light pipe 102-2 includes diverting surface 108-3 to orient the incoming light beam at an angle of about 45 degrees (also seen in FIGS. 2 and 3). Additionally, the second end of the light pipe 102-2 includes the diverting surface 108-4 to orient the outgoing light beam at the diverting angle. The first end of the third light pipe 102-3 includes the diverting surface 108-5 (also shown in FIG. 3) and 108-6 to orient the incoming light at the diverting angle and the second end of the third light pipe 102-3 then transmits the light to a light detector 110, such as a phototransistor, a photodiode, or any other light sensing device known in the art. It will be understood that the quantity of light pipes 102, light sources 106, and light detectors 110 may vary based on the requirement.

In one example implementation, sensing system 100 also includes one or more reflecting surfaces 112, such as reflecting surfaces 112-1 and 112-2. Examples of reflective surfaces 112 and light pipes 102 include mirrors, prismatic structures, light guides with deflecting surfaces, etc.

In one implementation, light source 106 and light detector 110 are on opposite sides of the banknote thus forming a cross channel sensor. Further, the banknote 104 may be stationary, and the light source 106 and the light detector 110 may move. In another implementation, light source 106 and light detectors 110 are on the same side of the banknote 104 while the reflective surfaces 112 are on the opposite side of the banknote 104. The reflecting surfaces 112 reflect the light transmitted though the banknote 104 towards the light pipes 102. It will be understood that other implementations are also possible. Further, it will be understood that the light beam from the light source 106 undergoes other losses, such as absorption losses at the banknote 104 surface, however such losses are negligible in light of losses due to reflection, transmission, etc. The operational details of the sensing system 100 are explained in the following paragraphs.

In one implementation, the banknote 104 is accepted and transported along the transport path 114. The sensing system 100 is provided along the transport path 114 to track the progress of the banknote 104 from the entry point to the various units, such as recyclers, storage, dispenser, etc. In one implementation, when it is determined that a banknote 104 is accepted, light source 106 emits a light beam A to illuminate the banknote 104 with at least one particular wavelength. Light source 106 emits light beam A at predefined time intervals to detect the progress of banknote 104. Light beam A first passes through light pipe 102-1. Light beam A gets reflected at a diverting angle defined by the diverting surface 108-1. Light beam A then strikes banknote 104 at the angle of incidence defined by the diverting surface 108-2 of the light pipe 102-1. A part of light beam A gets reflected off the surface of banknote 104 as light beam B, while a first portion of light beam A, i.e. as $A_1$, gets transmitted through banknote 104 and is focused onto a reflective surface 112-1. It should be noted that the first portion of the beam, i.e., light beam $A_1$, which gets transmitted through banknote 104 suffers geometrical phase shift due to refraction. Also, the intensity of light beam A that gets transmitted, i.e. light beam $A_1$, depends in part on the angle of incidence of the irradiated light beam.

Transmitted light beam $A_1$ reflects off the reflective surface 112-1 towards banknote 104. Again, a part of transmitted light beam $A_1$ gets reflected off surface of banknote 104 as $B_1$, while a part of light beam $A_1$ (in other words, a second portion of the light beam A) passes through banknote 104 into light pipe 102-2 as $A_2$ in a second pass. At this stage, a light detector similar to light detector 110 can be placed to read light beam $A_2$. In other words, if a dual pass reading is desired, light detector 110 can be placed at the second end of the light pipe 102-2. However, if a four pass reading is desired, light beam $A_2$ is made to further pass through the banknote 104 a couple more times as described below.

In a quad pass sensing system 100, light beam $A_2$ passes through light pipe 102-2 and gets re-oriented due to diverting surfaces 108-3 and 108-4. Accordingly, light beam $A_2$ gets re-directed onto the surface of the banknote 104. Again a portion of light beam $A_2$ gets reflected off banknote 104 as light beam $B_2$ and a third portion of light beam A gets transmitted through banknote 104 as light beam $A_3$. Light beam $A_3$ too experiences geometric shift due to refraction. Transmitted light beam $A_3$ bounces off reflecting surface 112-2 onto banknote 104. The part of light beam $A_3$ that gets transmitted is hereinafter referred to as $A_4$ and the reflected portion is referred to as light beam $B_4$. Light beam $A_4$ also suffers geometric shift due to refraction as it passes through banknote 104 towards the first end of light pipe 102-3. Diverting surfaces 108-5 and 108-6 in light pipe 102-3 orient the light towards the second end of the light pipe 102-3 where the light detector 110 is placed.

In one implementation, light detector 110 detects the remaining light beam $A_4$. A controller 116 coupled to the light detector 110 then calculates the intensity of light of light beam $A_4$. Due to multiple passes through light pipes 102 and losses due to reflection, light beam $A_4$ received by light detector 110 undergoes degradation to a level where it can be differentiated from light detector 110 output when banknote 104 is absent. Also, due to geometric shifts as a result of refraction, light beam $A_4$ may even miss light detector 110 at high angles of incidence, giving the impression that banknote 104 is present.

Also, controller 116 pre-computes the intensity of light without banknote 104 present and stores it as an absence threshold. Controller 116 compares absence threshold with the intensity of light of light beam $A_4$ to determine whether banknote 104, such as a polymer banknote, is present or not. Conventionally, for polymer notes, the intensity of the light beam through transparent windows 105 would be approximately equal to the absence threshold indicating absence of note. Such an incorrect determination is more prominent with polymer notes. However, by varying angle of incidence, reflection is optimized and extinction ratios are controlled so that a polymer banknote can be differentiated from an "absence of note" scenario.

In an implementation, the intensity of light beam obtained through the banknote, such as a paper banknote, is also pre-computed and stored as presence threshold. If the light intensity is less than the absence threshold, it is ascertained that banknote 104 is present. Due to multiple passes through light pipes 102, losses due to reflection, and geometric shifts due to refraction, the light beam transmitted through the transparent banknotes 104 undergoes degradation to a point where the light intensity is in between the absence threshold and presence threshold. Through additional statistical analysis of intensity data, specific attributes of banknote 104 can be further calculated. For example, it can be determined whether banknote 104 is taped, has windows, or holes, etc.

In another example embodiment, the movement of light source 106 and light pipes 102 can be controlled via the controller 116. Controller 116 adjusts the orientation of light pipes 102, which in turn controls the angle of incidence of light onto reflective surfaces 112 and banknote 104.

Figure 2:
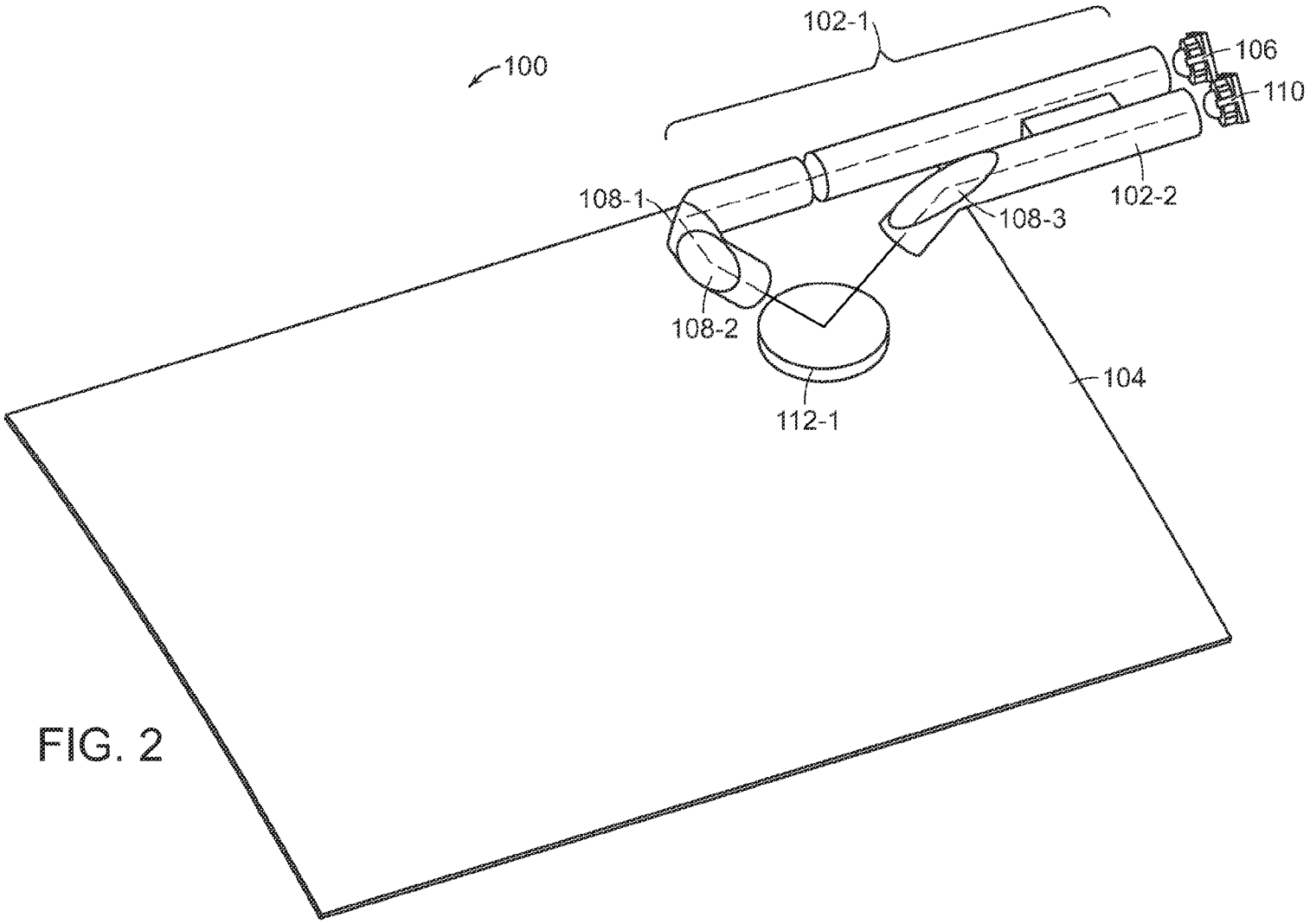
FIG. 2 illustrates an exemplary sensing system having a 45 degree angle of incidence and supporting two passes, in accordance with the present subject matter.
Figure 3:
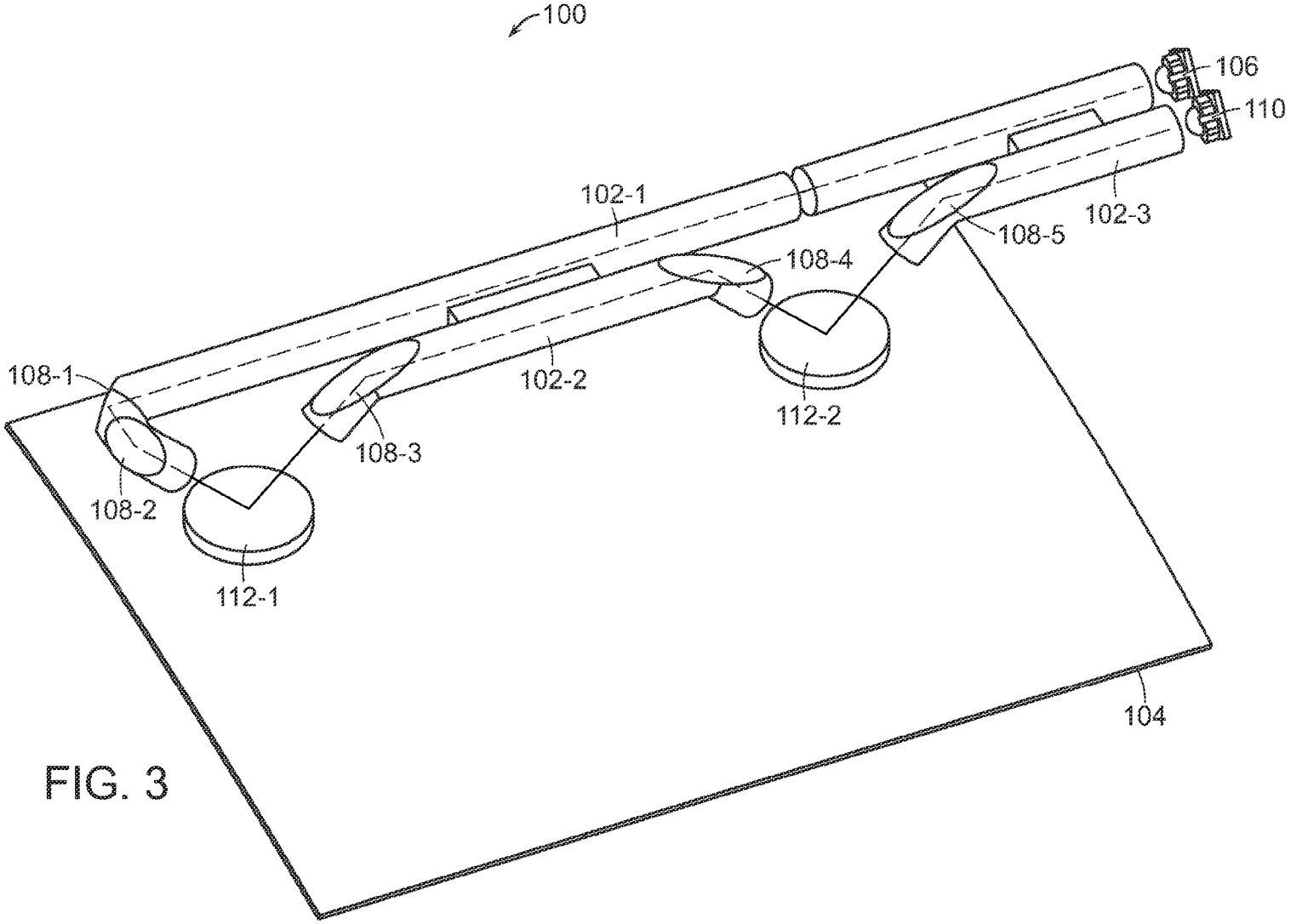
FIG. 3 illustrates an exemplary sensing system having a 45 degree angle of incidence and supporting four passes, in accordance with the present subject matter.

The reflected energy may be made to go through multiple passes via one or more light pipes 102 or wave guides. Each pass includes orienting the angle of incidence of light at an angle to optimize the reflected energy off banknote 104. It will be noted that the refractive and reflective effects tend to multiple, as number of passes increases. FIG. 2 shows one such arrangement with two light pipes, dual pass, and about 45 degree angle of incidence. FIG. 3 shows sensing system 100 with three light pipes, four passes, and about 45 degree angle of incidence, according to an embodiment of the present subject matter.

As an example, a lambertian source is simulated to imitate a light emitting diode 106 in TRACEPRO®. The lambertian source is simulated to provide 1 Watt total output, 940 nm, 200000 rays. The following data is obtained by the light detector 110

| Optical Configuration | Air | Transparent Banknote | Extinction Ratio |
|---|---|---|---|
| Single pass, 0 degree angle of incidence | 0.01731 | 0.01606 | 1.08 |

-continued

| Optical Configuration | Air | Transparent Banknote | Extinction Ratio |
|---|---|---|---|
| Dual pass, 0 degree angle of incidence | 0.00036 | 0.00035 | 1.02 |
| Dual pass, 45 degree angle of incidence | 0.00847 | 0.00728 | 1.16 |
| Quad pass, 45 degree angle of incidence | 0.00239 | 0.00148 | 1.61 |
| Quad pass, 60 degree angle of incidence | 0.00076 | 0.00038 | 1.98 |

As seen in table above, about 45 degree angle of incidence is a good compromise between overall signals levels and extinction ratio.

Figure 4:
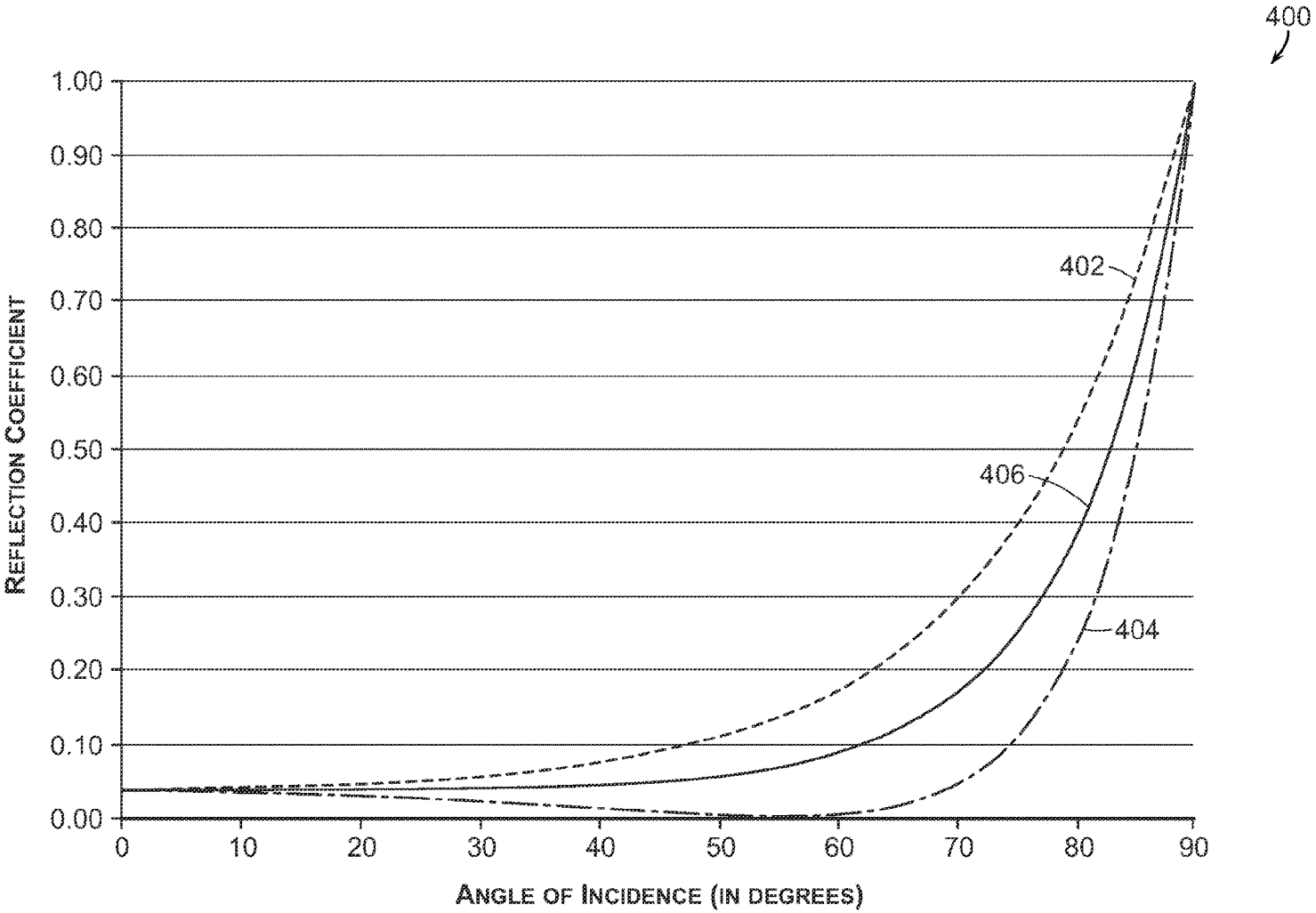
FIG. 4 illustrates a relationship between angle of incidence of light and reflection coefficient.

FIG. 4 illustrates a graph 400 illustrating the variation between the angle of incidence of light, for example from light source 106, and the reflection coefficient for polypropylene, a material commonly used for making polymer notes. Polypropylene has a reflective index of 1.49. The curve 402 is for s-polarized light, curve 404 is for p-polarized light, and curve 406 is for un-polarized light. As shown in FIG. 4, the reflection coefficient increases as the angle of incidence increases. Thus, to maximize the reflected energy off banknote 104, the angle of incidence is increased. The present subject matter is explained with angle of incidence to be about 45 degrees, however, higher angles of incidence are also possible as would be apparent to a person skilled in the art.

Figure 5A:
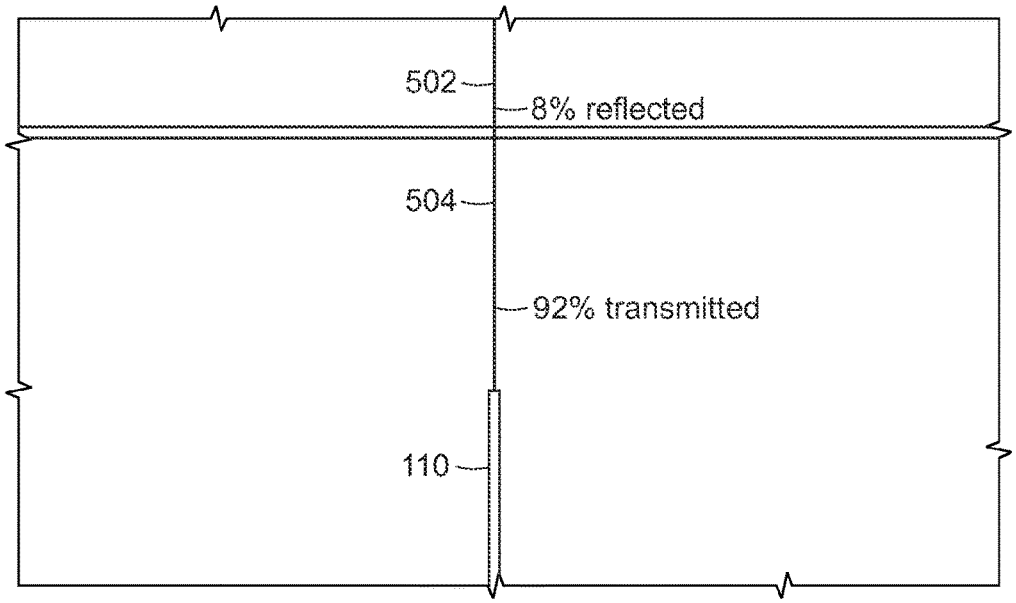
FIG. 5(*a*) illustrates that at normal incidence, a substantial amount of light transmits through the valuable document.
Figure 5B:
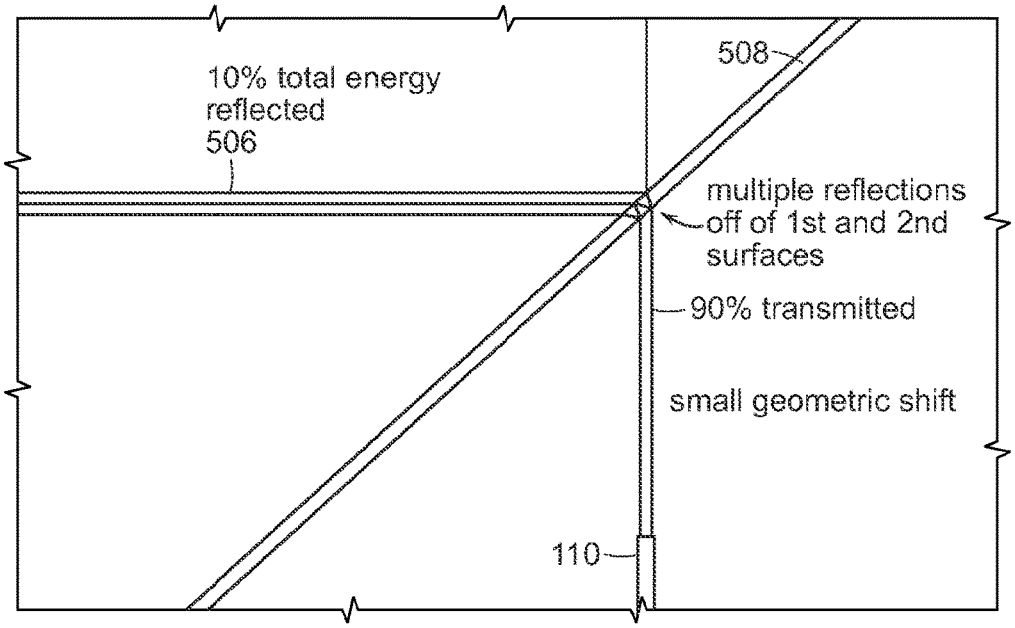
Figure 5C:
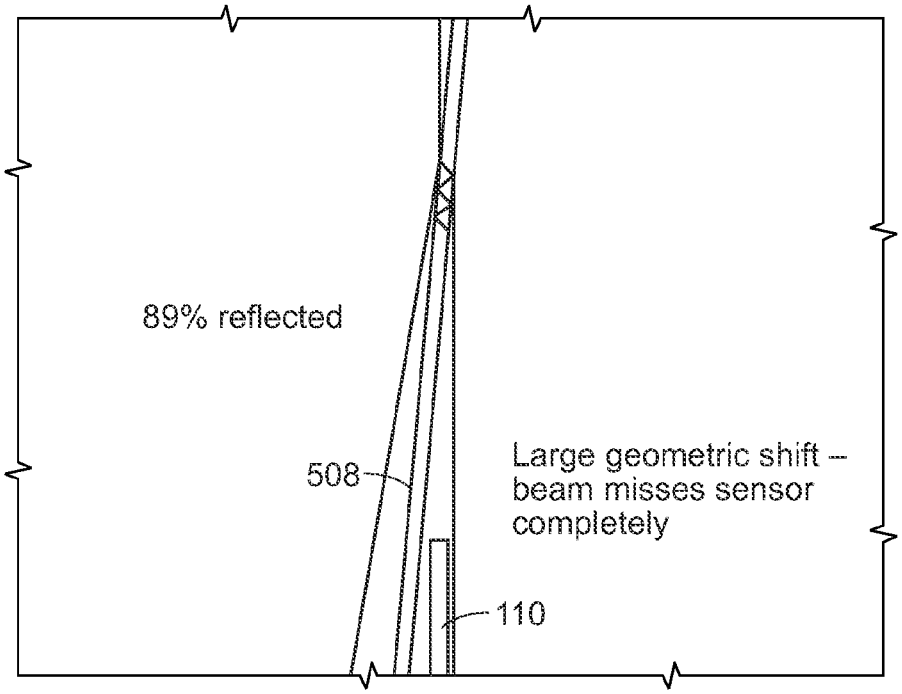

FIGS. 5(*a*), 5(*b*), and 5(*c*) are exemplary illustrations of the change in reflected energy and transmitted energy with a change in the angle of incidence.

FIG. 5(*a*) shows that at zero degree angle of incidence, there is a small reflection 502 (about 8%) every time light passes through an interface, while the rest gets transmitted 504.

FIG. 5(*b*) shows that at 45 degree of angle of incidence, the reflections off the first and the second interfaces becomes more apparent as the angle of incidence increases. This is shown by light path 506 as 10% of the light gets reflected. Additionally, there is a small shift in the transmitted light 508 due to refraction. This is further illustrated in the table below.

FIG. 5(*c*) shows that at about an 85 degree angle of incidence, the reflection coefficient of banknote 104 determines, in part, the amount of light that is transmitted. In a ideal theoretical case, about 0% of the original incident beam reaches light detector 110, when a transparent banknote 104 is present due to large refraction coefficient and refraction shift, and thus in effect transmitted light 508 misses light detector 110 giving the impression that banknote 104 is present. This works particularly well for banknotes 104 having transparent windows 105 which would otherwise be treated as absence of note by a conventional sensor.

Figure 6:
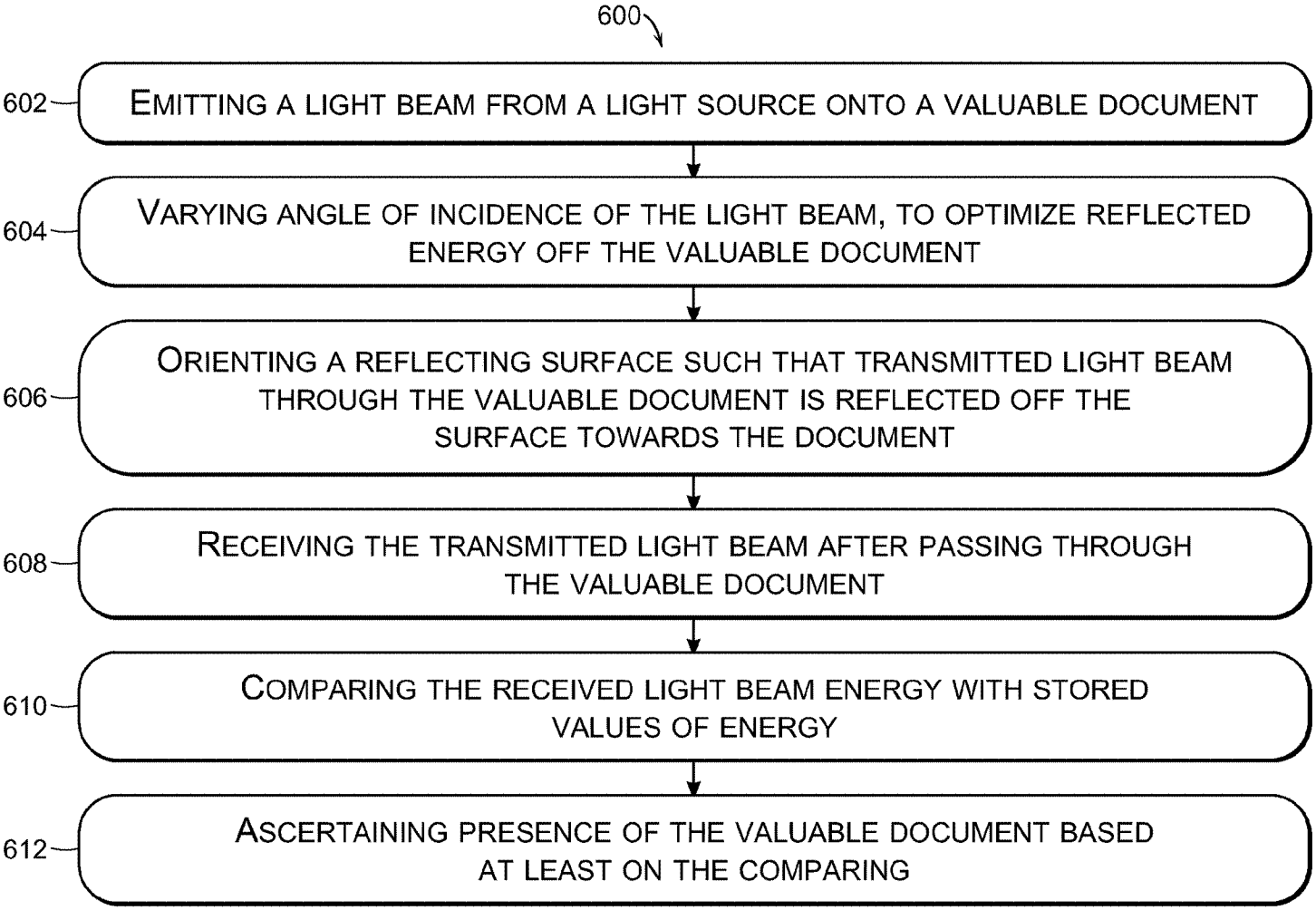
FIG. 6 an exemplary method for processing the valuable documents, in accordance with the present subject matter.

FIG. 6 illustrates an exemplary method 600 for processing valuable documents, such as banknotes 104 with transparent windows 105, in accordance with an example embodiment of the present subject matter. Method 600 is described in the context of banknotes 104; however, method 600 may be extended to cover other kinds of items of value. Herein, some embodiments are also intended to cover program storage devices, for example, digital data storage media, which are machine or computer readable and encode machine-executable or computer-executable programs of instructions, wherein said instructions perform some or all of the steps of the described method. The program storage devices may be, for example, digital memories, magnetic storage media such as a magnetic disks and magnetic tapes, hard drives, or optically readable digital data storage media.

The order in which the method is described is not intended to be construed as a limitation, and any number of the described method blocks can be combined in any order to implement the method, or an alternative method. Additionally, individual blocks may be deleted from the method without departing from the spirit and scope of the subject matter described herein. Furthermore, the method can be implemented in any suitable hardware, software, firmware, or combination thereof.

At block 602, a light beam is emitted from a light source onto a valuable document. In an example, light source 106 generates a light beam onto a valuable document, such as banknote 104 with one or more transparent windows 105. In one implementation, the light beam passes through one or more light pipes 102. Light pipes 102 have one or more diverting surfaces 108 to direct the light in the desired direction and angle of incidence.

At block 604, angle of incidence of the light beam is varied such that the reflected energy off the valuable document is optimized. In one implementation, the angle of incidence of light can be varied between 0 and approximately 90 degrees to optimize the reflected energy off the banknote 104. Such considerations can be made at the design stage by determining the desired amount of reflected energy and accordingly, selecting type and placement of diverting surfaces 108. Alternatively, the real-time adjustments can be made via a controller 116.

At block 606, a reflecting surface is oriented such that the transmitted light beam through the valuable document is reflected by the reflecting surface and towards the document. Position of reflective surfaces 112 can be either selected during the design or during operation via a controller 116.

At block 608, the transmitted light beam through the valuable document is received. In one implementation, one or more light detectors 110 are placed either on the same side of banknote 104 as light source 106 or on the opposite side. Light detectors 110 are positioned to receive light transmitted through banknote 104. In one example, light detector 110 may be coupled to another light pipe, such as light pipe 102-3. Controller 116 coupled to the light detector 110 measures the transmitted light beam and stores the light intensity and other related parameters.

At block 610, the transmitted light beam energy is compared with predetermined value. In one example implementation, controller 116 compares the light beam received by light detector 110 with predetermined values or patterns. The values correspond to an absence of banknote, and presence of banknotes, such as paper banknotes.

At block 612, presence of the valuable document 104 is ascertained based at least on the comparison at block 610. If the light intensity is less than the absence value, it is ascertained that banknote 104 is present. Due to multiple passes through light pipes 102, losses due to reflection, and geometric shifts due to refraction, the light beam through banknotes 104 undergoes degradation to a point where the light intensity is in between the absence and presence value. Through additional statistical analysis of intensity data, specific attributes of banknote 104 can be further calculated. For example, it can be determined whether banknote 104 is taped, has windows, or holes, etc.

Various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Although embodiments for a system to process valuable documents have been described in language specific to structural features and/or methods, it is to be understood that the invention is not necessarily limited to the specific features or methods described. Rather, the specific features and methods are disclosed as exemplary embodiments for the system to process valuable documents.

What is claimed is:

1. A sensing system to process at least one valuable document, the system comprising:

a light source to generate a light beam;

at least one light pipe coupled to the light source, wherein the light pipe has one or more diverting surfaces to direct the light beam at a predetermined angle of incidence onto the valuable document, wherein the one or more diverting surfaces are formed in one or more bent end portions of the at least one light pipe, and wherein the one or more bent end portions are angled in relation to the valuable document;

at least one reflective surface to receive a first portion of the light beam transmitted through the valuable document and to reflect the first portion of the light beam towards the valuable document; and another light pipe to receive at least a second portion of the light beam re-transmitted through the valuable document, wherein the another light pipe has one or more diverting surfaces formed in one or more bent end portions of the another light pipe, wherein the one or more diverting surfaces of the another light pipe direct at least the second portion of the light beam to a light detector.

2. The sensing system as claimed in claim 1, wherein at least one of the diverting surfaces are angled between 0 and about 90 degrees.

3. The sensing system as claimed in claim 1, wherein intensity of the second portion of the light beam is based at least on the angle of incidence.

4. The sensing system as claimed in claim 1, wherein the reflective surface is angled such that the first portion of the light beam reflecting from the reflective surface reflects off substantially in a direction towards the valuable document.

5. The sensing system as claimed in claim 1 further comprising at least one controller configured to vary the angle of incidence by varying an angle of the diverting surface.

6. The sensing system as claimed in claim 1, wherein at least one of the angle of incidence, number of passes, and an amount of refraction determines an extinction ratio.

7. The sensing system as claimed in claim 1, wherein the valuable document is at least one of a coupon, a check, a security document, a banknote, and a voucher, and wherein the valuable document has one or more transparent windows.

8. The sensing system as claimed in claim 1, wherein the valuable document is a polymer banknote.

9. The sensing system as claimed in claim 5, wherein the light detector is coupled to the controller, and wherein the controller is configured to:

store data of the second portion of the light beam received by the light detector; and compare the data of the second portion of the light beam with a predetermined value.

10. The sensing system as claimed in claim 9, wherein the controller determines a presence of the valuable document based at least on the comparison.

11. The sensing system as claimed in claim 1, wherein the sensing system is implemented in one of a vending machine, an automatic teller machine, a gaming machine, a currency validator, and a bill validator.

12. A method comprising:

emitting a light beam from a light source onto a valuable document;

optimizing reflected energy off the valuable document by varying an angle of incidence of the light beam onto the valuable document;

orienting a reflective surface such that a first portion of the light beam transmitted through the valuable document is reflected off towards the valuable document;

orienting one or more diverting surfaces at a diverting angle such that a second portion of the light beam is re-transmitted through the valuable document to the one or more diverting surfaces at a diverting angle, wherein the second portion of the light beam is a part of the first portion of the light beam, wherein the one or more diverting surfaces are formed in one or more bent end portions of at least one light pipe, and wherein the one or more bent end portions are angled in relation to the valuable document;

receiving the second portion of the light beam at another light pipe, wherein the another light pipe has one or more diverting surfaces formed in one or more bent end portions of the another light pipe, wherein the one or more diverting surfaces of the another light pipe direct the second portion of the light beam to a light detector; and obtaining, by the light detector, the second portion of the light beam reflected off the one or more diverting surfaces of the another light pipe.

13. The method as claimed in claim 12 further comprising, storing intensity data of the transmitted light beam; and comparing the intensity data with a predetermined value.

14. The method as claimed in claim 13 further comprising differentiating between a presence of the valuable document and an absence of the valuable document based at least on the comparison.

15. The method as claimed in claim 13 further comprising differentiating between the valuable document and other types of documents based at least on the comparison.

16. The method as claimed in claim 12, wherein the method is implemented in one of a vending machine, an automatic teller machine, a gaming machine, a currency validator, a pay phone, a computer, and a hand-held device.

17. The method as claimed in claim 12, wherein the transmitted light beam is made to undergo one or more passes through the valuable document before being received by the light detector.

* * * * *